US009009868B2

(12) United States Patent
Mazzarolo

(10) Patent No.: US 9,009,868 B2
(45) Date of Patent: Apr. 21, 2015

(54) GLOVE STRUCTURE, IN PARTICULAR FOR MOTORCYCLING SECTOR

(75) Inventor: Giovanni Mazzarolo, Coste di Maser (IT)

(73) Assignee: Alpinestars Research SRL, Coste di Maser (Treviso) (IT)

( * ) Notice: Subject to any disclaimer, the term of this patent is extended or adjusted under 35 U.S.C. 154(b) by 389 days.

(21) Appl. No.: 13/058,855

(22) PCT Filed: Aug. 13, 2009

(86) PCT No.: PCT/IB2009/053574

§ 371 (c)(1),
(2), (4) Date: Feb. 12, 2011

(87) PCT Pub. No.: WO2010/018552

PCT Pub. Date: Feb. 18, 2010

(65) Prior Publication Data

US 2011/0131703 A1 Jun. 9, 2011

(30) Foreign Application Priority Data

Aug. 13, 2008 (IT) ..... TV2008A0107

(51) Int. Cl.
*A41D 13/08* (2006.01)
*A41D 19/00* (2006.01)
(Continued)

(52) U.S. Cl.
CPC ..... *A41D 19/01523* (2013.01); *A41D 13/0153* (2013.01); *A41D 2600/102* (2013.01)

(58) Field of Classification Search
CPC ..... A41D 19/00; A41D 19/015; A41D 19/01582; A41D 19/01588; A41D 19/01523; A41D 19/01505; A41D 13/081; A41D 13/087; A41D 13/0153; A41D 2600/102; A63B 71/143; A63B 71/141; A63B 71/148; A61F 5/013; A61F 5/0118; A61F 5/05866; A61F 5/05875
USPC ..... 2/16, 20, 158, 159, 160, 161.1, 161.6, 2/161.5, 162, 163, 19; 128/877–880; 602/21, 22, 30
See application file for complete search history.

(56) References Cited

U.S. PATENT DOCUMENTS 381,687 A * 4/1888 Fischer ..... 2/19
2,488,697 A 9/1948 Bakke
(Continued)

FOREIGN PATENT DOCUMENTS

DE 202007012154 U1 10/2007
GB 2368775 A 5/2002
(Continued)

OTHER PUBLICATIONS

"PCT International Search Report dated Nov. 27, 2009 for PCT/IB2009/053574, from which the instant application is based," 4 pgs.
(Continued)

*Primary Examiner* — Alissa L Hoey
*Assistant Examiner* — Jameson Collier
(74) *Attorney, Agent, or Firm* — Fredrikson & Byron, P.A.

(57) ABSTRACT

A motorcycle glove structure comprises a system for protecting the fingers, made with a double layer of plastic, the first layer (26) of which is injected directly and coextensively onto a flat part made of leather or similar material or fabric (24). The second layer (28) made of impact and abrasion resistant plastic is injection-molded over the first layer and preferably has projections (30) opposite the minor knuckles. The structure also comprises a shield (38) which is made of impact and abrasion resistant plastic applied to the back of the hand and which has at the front portions (40) shaped so as to mate with projections (32) formed at the end of said second layer (28) for protecting the fingers, said co-operating projections being positioned opposite the makor knuckles of the hand. The shield (38) has, co-operating therewith, a sleeve part (48) which is fixed to the glove beyond the wrist line and is provided with a rib (54) against which the rear end of said shield comes into contact when a force is applied in the direction from the fingers towards the wrist.

19 Claims, 5 Drawing Sheets

(51) Int. Cl.

| | |
|---|---|
| ***A63B 71/14*** | (2006.01) |
| ***A41D 19/015*** | (2006.01) |
| *A41D 13/015* | (2006.01) |

(56) References Cited

U.S. PATENT DOCUMENTS

| | | | | | |
|---|---|---|---|---|---|
| 4,042,975 | A | * | 8/1977 | Elliott et al. | 2/19 |
| 4,524,464 | A | * | 6/1985 | Primiano et al. | 2/16 |
| 4,570,269 | A | | 2/1986 | Berlese | |
| 4,675,914 | A | * | 6/1987 | Mitchell | 2/161.1 |
| 4,864,660 | A | | 9/1989 | Sawyer | |
| 5,163,678 | A | * | 11/1992 | Rogers | 473/59 |
| 5,819,312 | A | * | 10/1998 | Snyder et al. | 2/16 |
| 5,898,938 | A | * | 5/1999 | Baylor et al. | 2/20 |
| 5,946,720 | A | * | 9/1999 | Sauriol | 2/16 |
| 5,983,396 | A | * | 11/1999 | Morrow et al. | 2/161.1 |
| 6,681,403 | B2 | * | 1/2004 | Lyden | 2/22 |
| 6,918,137 | B2 | * | 7/2005 | Fowler | 2/16 |
| 7,043,769 | B2 | * | 5/2006 | Chung | 2/161.1 |
| 7,234,172 | B1 | * | 6/2007 | Hoelscher | 2/161.1 |
| 2003/0066119 | A1 | * | 4/2003 | Mazzarolo | 2/161.1 |
| 2006/0010562 | A1 | | 1/2006 | Bevier | |
| 2006/0253951 | A1 | * | 11/2006 | Mueller et al. | 2/16 |
| 2007/0020435 | A1 | | 1/2007 | Williams | |
| 2007/0083968 | A1 | | 4/2007 | Stokes | |
| 2011/0289643 | A1 | * | 12/2011 | Mazzarolo | 2/16 |

FOREIGN PATENT DOCUMENTS

| | | | |
|---|---|---|---|
| GB | 2379860 | A | 3/2003 |
| JP | 09262332 | A | 10/1997 |
| WO | 02076249 | A | 10/2002 |
| WO | 2005053447 | A | 6/2005 |

OTHER PUBLICATIONS

"PCT Written Opinion dated Nov. 27, 2009 for PCT/IB2009/053574, from which the instant application is based," 5 pgs.

"PCT International Preliminary Report on Patentability dated Nov. 18, 2010 for PCT/IB2009/053574, from which the instant application is based," 7 pgs.

"PCT International Search Report dated Oct. 15, 2009 for PCT/IB2009/053575," 3 pgs.

"PCT Written Opinion dated Oct. 15, 2009 for PCT/IB2009/053575," 7 pgs.

"PCT International Preliminary Report on Patentability dated Nov. 18, 2010 for PCT/IB2009/053575," 7 pgs.

* cited by examiner

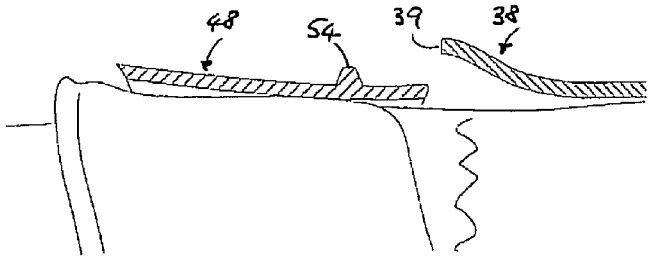
Fig. 6
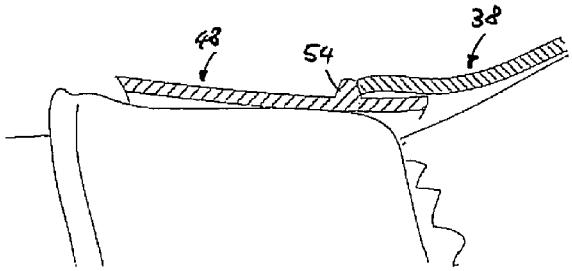
Fig. 6a
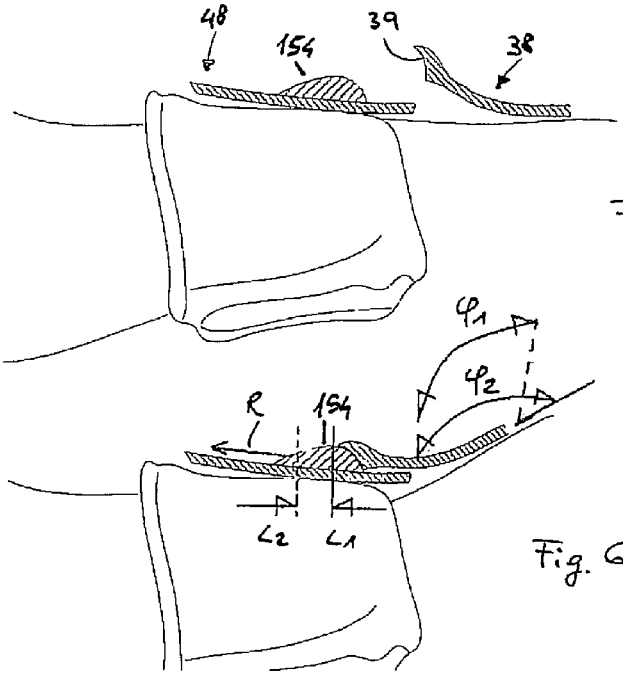
Fig. 6b
Fig. 6c

GLOVE STRUCTURE, IN PARTICULAR FOR MOTORCYCLING SECTOR

RELATED APPLICATIONS

This application is a 35 U.S.C. 371 national stage filing from International Application No. PCT/IB2009/053574 filed Aug. 13, 2009 and claims priority to Italian Application No. TV2008A000107 filed Aug. 13, 2008, the teachings of which are incorporated herein by reference.

FIELD OF THE INVENTION

The present invention relates to a glove structure and more specifically to a glove structure for motorcycle riding.

BACKGROUND

It is known that motorcycle riding gloves, in addition to providing protection against bad weather, must also be able to provide specific protection in the event of falls and accidents.

In such cases, the rider is projected from the saddle and, in view of the speed of the motorcycle at the moment of the accident and/or the fall, may slide over a distance of several meters on the road surface—and therefore on asphalt, grit or, in the best of circumstances, grass—suffering not insignificant injuries to the fingers, palm/back of the hands and/or the articulation between the arm and the wrist.

It may also happen that, during a fall, the rider's hand is trapped underneath the motorcycle so that injury, especially due to abrasion, is greatly worsened by the weight of the motorcycle pressing on the hand.

At the same time, the glove structure must not only be comfortable, but must also be able to offer the user the maximum freedom of movement of the hand and flexibility when riding a motorcycle.

In motorcycle glove structures of the known type for protecting the hands, and especially the upper part of the fingers and the hand, plastic moulded parts are usually applied, these being formed so as not to limit the freedom of movement of the hand and therefore the rider.

However, these protective devices, while obtaining the desired results with regard to sliding on the ground or on the road surface, are not effective for preventing and therefore providing complete protection against possible injury (fractures, sprains, or the like) which may affect the hand in the event of the rider suffering an accident or fall.

A further aspect not given due consideration hitherto is that the known glove structures, although being provided on the upper part with rigid protective devices, as regards the leather or fabric part are made in a conventional manner which envisages a plurality of stitches; these stitches, precisely as a result of friction against the road surface and/or grit, are prone to abrasive damage so that the glove opens in the region of the fingers and in particular the finger tips, thereby increasing the risk of injury due to abrasion and impact.

SUMMARY OF CERTAIN EMBODIMENTS OF THE INVENTION

A first object of the present invention is to provide a glove structure, in particular for motorcyclists, in which the stitches, in particular at the finger tips, are limited in terms of number and extent and protected, while providing at the same time rigid protection for the upper portion of the fingers.

A second object of the present invention is to provide a glove structure provided with a system for protecting the back of the hand, which not only ensures adequate protection against impacts and sliding abrasion, but is also able to interact with the rigid protection system for the fingers in the region of the major knuckles of the hand and with a further part for protecting the wrist joint.

A further object of the present invention is to provide a glove structure which has a section for protecting the wrist joint, which helps transmit the forces acting on the hand in the event of an accident or fall of the rider, preventing backwards twisting of the hand relative to the wrist beyond physiologically acceptable limits.

Yet another object of the present invention is to provide an improved method for manufacturing motorcycle glove structures with improved characteristics.

These and other objects according to the present invention are achieved with the glove structure and with the method as defined in the claims.

BRIEF DESCRIPTIONS OF DRAWINGS

The features and advantages of the present invention will emerge more clearly from the description which follows of a preferred embodiment, provided by way of a non-limiting example with reference to the accompanying drawings in which.

Figure 1:
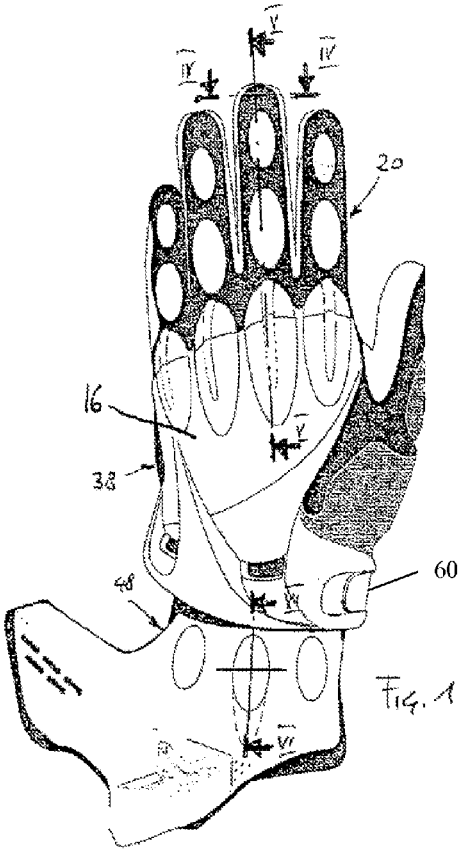
FIGS. 1 and 2 are plan views of the glove according to the invention from the back side and from the palm side, respectively.
Figure 4:
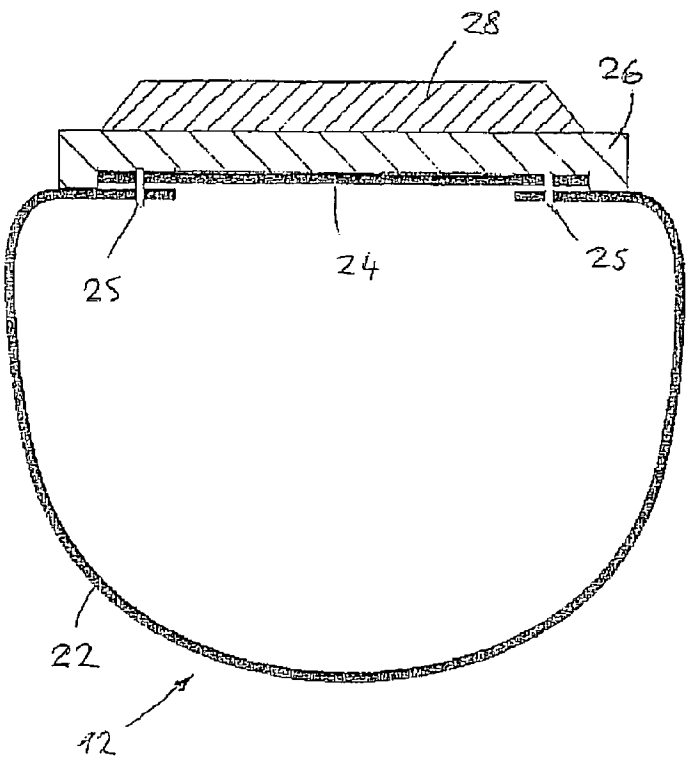
FIG. 4 is a cross-section along the plane IV-IV of FIG. 1.
Figure 4A:
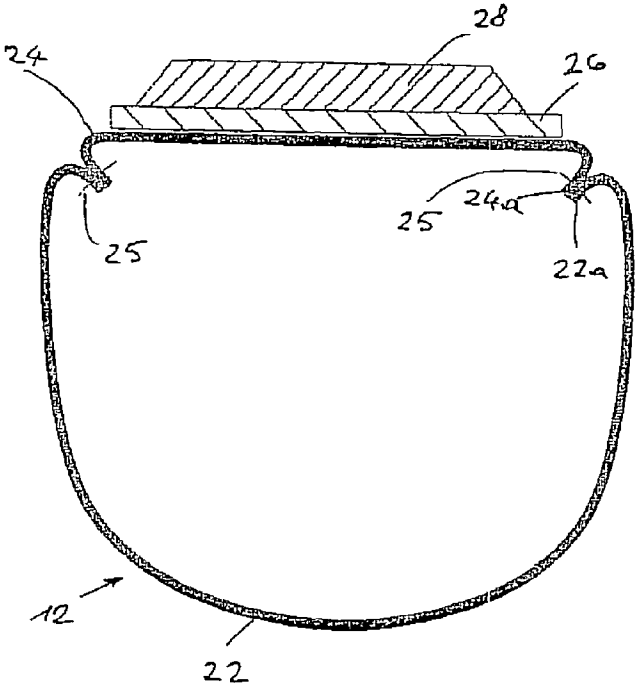
Figure 5:
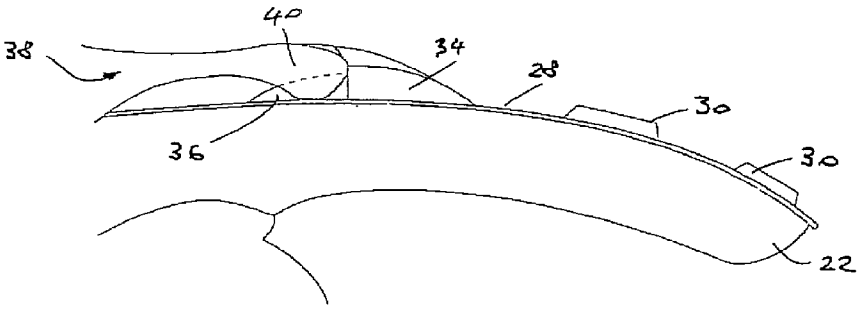
Figure 5A:
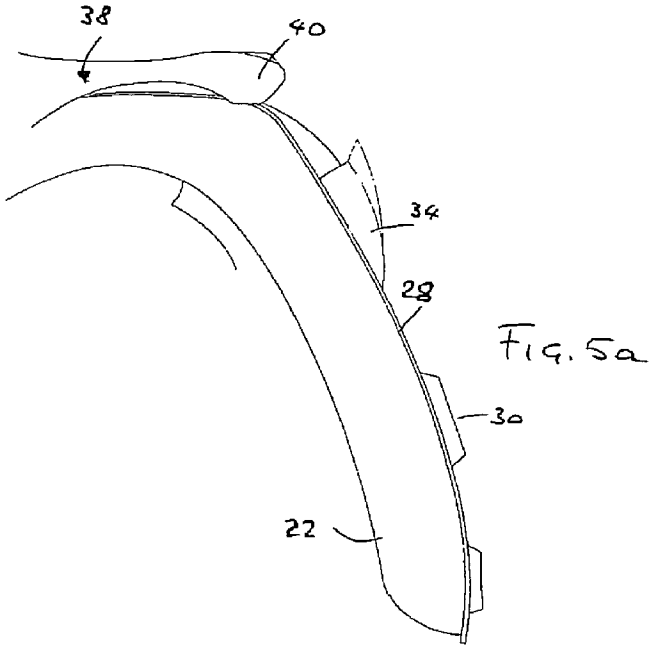

FIG. 4*a* is a variant of FIG. 4;

FIG. 5 is a cross-section along the plane V-V of FIG. 1;

FIG. 5*a* is a view, similar to that of FIG. 5, which shows the glove in a different operating configuration;

FIGS. 6 and 6*a* are views similar to FIGS. 5 and 5*a*, along the cross-sectional plane VI-VI of FIG. 1;

FIGS. 6*b* and 6*c* are variants of FIG. 6 and FIG. 6*a*, respectively.

DETAILED DESCRIPTION OF EMBODIMENTS OF THE INVENTION

Figure 2:
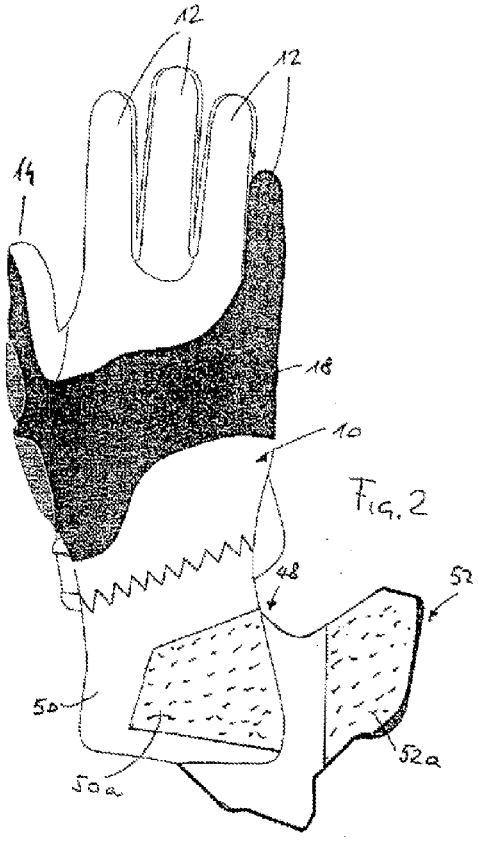
Figure 3:
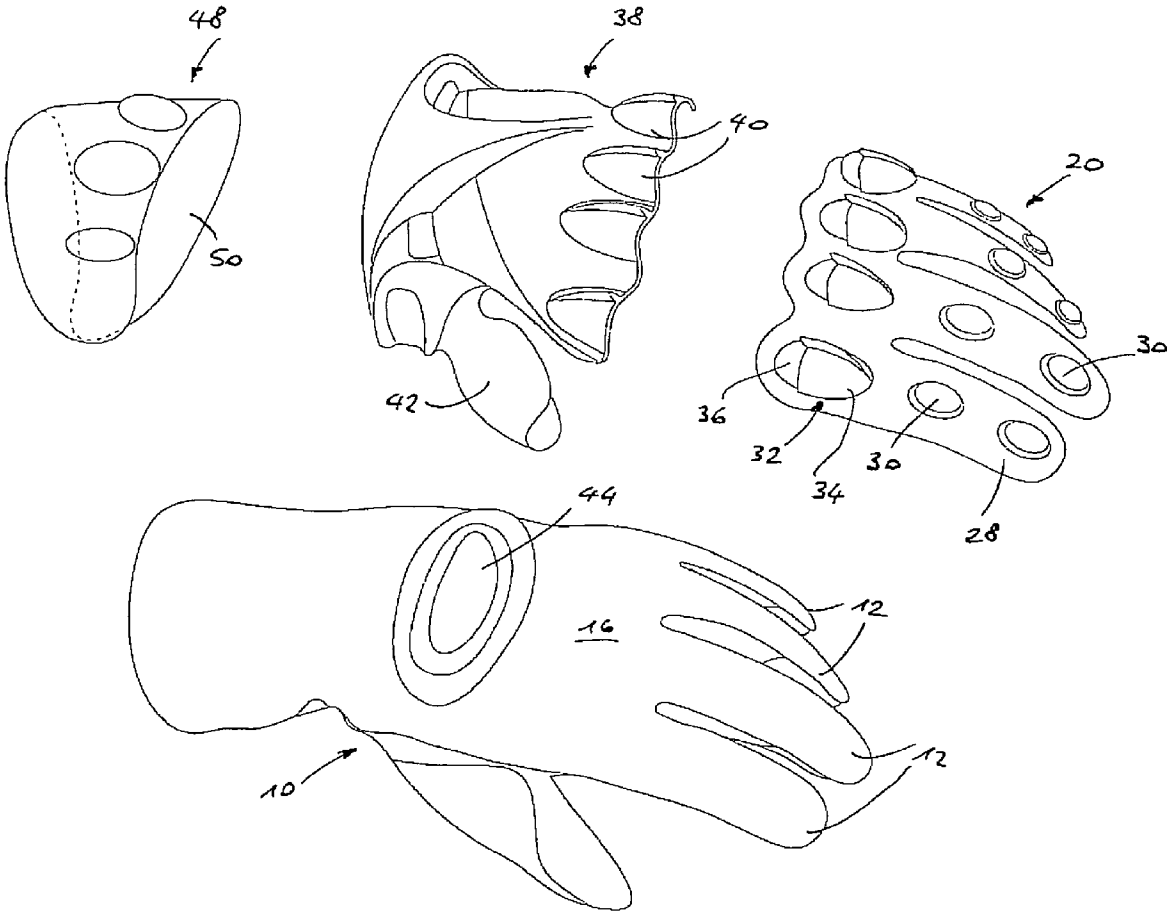
FIG. 3 is an exploded view of the glove according to the invention.

With reference firstly to FIGS. 1-3, the glove structure according to the present invention consists of an actual glove—indicated by the generic reference number 10—which is made of leather or other similar material or fabric and comprises four fingers 12, a thumb 14, a back zone 16 and a palm zone 18.

Accordingly, for the purposes of the present invention, the term finger must be interpreted as not including the thumb.

Furthermore, from the purpose of the present invention, the term upper portion of the finger is intended to relate to the portion of the finger corresponding to the back hand whereas the term lower portion of the finger is intended to relate to the opposite portion.

As shown in FIGS. 1-3, the glove terminates in a sleeve which, when the glove is worn, extends beyond the wrist joint.

In FIG. 3 the reference number 20 indicates a system for protecting the upper portion of the fingers which in reality is preferably formed integrally with the leather forming the glove fingers, as shown more clearly in FIG. 4 and FIG. 4*a* which relates to a variant.

From these figures it can be seem that each glove finger 12 consists of two elements (indicated respectively by the reference numbers 22 and 24) which are made of leather or also a similar material or a tough fabric and are joined together by stitching lines 25.

Preferably, the first element 22 is pre-shaped by means of a press in the form of a U and corresponds to the lower part of the finger, i.e. the fleshy part of the finger. The second element 24 is substantially flat.

A layer 26 of plastic material, preferably non-rigid polyurethane, is applied on top of the second element by means of direct injection or, alternatively, by means of an adhesive film or glue (not shown). Then a second layer 28 of plastic material, preferably rigid polyurethane, could be injection-moulded over the layer 26 so as to form together with the latter the upper protection 20 of the fingers. It should be noted that the illustration shown in FIG. 3 is to be interpreted regarding the finger protection system 20 as being not separate or separable from the fingers 12, but forming an integral part thereof.

From FIGS. 1 to 3 it can be seen how the layer 28 could be formed with protuberances—generally indicated by the reference number 30—which are situated opposite the minor knuckles, i.e. the articulations of the phalanges of the fingers.

Moreover, further projections 32 could be provided opposite the major knuckles, these being oval- and convex-shaped at the front (i.e. towards the finger tips) in the manner of a fingernail 34 and at the rear with a tapered portion 36 which is smaller in height, for the purpose explained below.

According to an important characteristic feature of the invention, the stitching lines 25, along the perimetral edges 22*a* and 24*a* of the elements 22 and 24 are no longer exposed in the finished glove and consequently are protected in the event of an accident. In fact, the stitches 25 are entirely or partly covered by the layer 26 in the case of FIG. 4 and are internal in the variant according to FIG. 4*a*.

With reference again to FIGS. 1 and 3, the generic reference number 38 indicates a shield for protecting the back of the hand, which extends from the major knuckles, namely from the finger joints to a short distance from the wrist.

As shown in FIG. 3, the shield 38 consists at the front in a plurality of fingernail oval- and convex-shaped portions 40, which correspond in number to the number of fingers, said portions 40 being such as to mate with the tapered portions 36 of the projections 32 formed at the ends of the fingers close to the joint with the back of the hand, although mutual fastening means are not envisaged.

In other words, the portions 40, when the shield 38 is positioned on the back of the glove in the manner explained below, rest on top of and cover the tapered portions 36 of the projections 32, forming an extension of the nail-like portions 34 of the projections 32.

The shield 38 also comprises a U-shaped part 42 which is designed to mate with the part where the thumb is attached to the glove body.

In order to fix the shield 38 to the glove body, the upper part of the glove has a projection 44, which has a substantially oval shape and is made of material such as Velcro® and the corresponding inner surface of the shield has a portion which is also lined with Velcro® so that the shield is removably secured in position.

As shown in FIG. 1, fixing of the shield to the glove body is completed with a strap-type closure 60 which, when closed, extends between the two lateral edges of the shield in the region of the wrist of the glove body.

Finally, the glove structure according to the present invention is completed by a sleeve 48 comprising a portion 50 permanently fixed to the glove body in the portion beyond the wrist and a flap or panel 52 able to be removably fixed to the portion 50 by means of two mating Velcro® surfaces (indicated by 50*a* and 52*a* in FIG. 2).

With reference now to FIGS. 5, 5*a* and 6, 6*a*, 6*b*, 6*c*, it is possible to appreciate the advantageous additional characteristics obtained with the glove structure according to the present invention.

When the hand—which during normal use when riding a motorcycle is curved forwards together with the glove (see FIG. 5*a*)—is straightened, an interference arises between the shaped portion 40 of the shield 38 and the nail-like portion 34 of the projection 32 protecting the major knuckle (see FIG. 5). Said interference is guided by engagement of the bottom surface of the shaped portion 40 with the tapered portion 36 of the projection 32 and prevents the fingers from passing beyond the condition where they are aligned with the back of the hand.

At the same time, in the event of an accident with sliding, the continuous protection of the back of the glove and therefore the hand is ensured, avoiding the situation where the major knuckle zone is protected solely by the glove leather.

If we now consider FIGS. 6 and 6*a*, it can be easily seen how a rib 54 is provided integrally on the sleeve 48, parallel to the wrist of the glove.

In normal riding conditions there is no interference between sleeve 48 and shield 38, so that the riding action is not hindered (see FIG. 6).

In the event of an accident, where forces are transmitted from the fingers, so that the hand tends to arch with respect to the wrist and the arm, the rear edge 39 of the shield 38 comes into contact against the rib 54. In this way, the aforementioned forces are transmitted to the sleeve 48, avoiding disastrous consequences for the integrity of the wrist bones.

FIGS. 6*b* and 6*c* show a variant of FIGS. 6 and 6*a*, respectively, in which the rib 154 against which the rear edge 39 of the shield 38 comes into contact is a part which is fixed onto the sleeve 48 slidably in the direction of the R in FIG. 6*c*. In this way it is possible to adjust, depending on the anatomical characteristics of each user, the amplitude of the maximum permissible arching of the hand relative to the wrist and to the arm. FIG. 6*c* therefore shows, by way of example, two possible arrangements $L_1$ and $L_2$ of the rib 154 on the sleeve 48 and the corresponding arching angles $\phi_1$ and $\phi_2$.

The invention has been described in connection with a preferred embodiment, but it is understood that conceptually and mechanically equivalent modifications and variations are possible and may be applied without departing from the scope of the invention.

For example and firstly, the use of a shield 38 may be envisaged with a traditional glove structure having the usual protection system for the upper portion of the fingers, provided that this protection system comprises projections for protecting the major knuckles, such as those indicated by the reference number 32.

Secondly, it is possible to envisage providing a shield such as the shield 38 fixed permanently to the back of the glove, in which case it is not possible to use the glove in the so-called lightened version, namely with the shield 38 removed.

In the case of the shield 38 being permanently secured to the back of the glove, the possibility of defective positioning or detachment thereof is avoided, for example following an impact which causes its detachment from the Velcro® and/or the breakage of the closing and securing strap.

Finally, as regards the sleeve portion, it is clear that the rib 54, 154 performs a vital function for ensuring the transmission of forces acting on the fingers and/or on the hand, preventing them from being transmitted to more fragile zones of the human skeleton, such as the wrist zone or the region of the thumb articulation.

Finally it must be commented that the method of forming the glove fingers, with screening of the stitching and a substantial reduction of the latter, may also be easily applied to the manufacture of gloves of the traditional type provided solely with a rigid protection for the upper portion of the fingers.

The invention claimed is:

1. A glove and glove structure provided in combination for the motorcycling sector, wherein the glove structure is integrally formed with the glove, the glove having fingers with each finger consisting of two elements joined permanently together along joining lines, the glove structure comprising:

(a) a protecting device for protecting an upper portion of the fingers of the glove;

(b) a sleeve portion fixed to a region beyond a wrist portion of the glove;

(c) a shield for protecting a back hand portion of the glove, wherein the shield is provided with a plurality of projections at a front portion and with a single projection at a rear portion, the plurality of projections and the single projection adapted to be respectively engaged by corresponding projections provided on the protecting device and a projection on the sleeve portion, wherein the corresponding projections of the protecting device are configured to be respectively provided opposite major knuckles of a user's hand, each of the corresponding projections of the protecting device being oval-shaped and having a front portion with greater height than a tapered rear portion, the tapered rear portion of each corresponding projection of the protecting device engaged by a bottom surface of one of the projections of the shield when the protecting device is aligned with the shield, the protecting device having a proximal edge configured to engage the front portion of the shield and a distal edge configured to correspond to the user's fingers, the proximal edge is directly attached to the back hand portion of the glove at a location that overlaps with the location of direct attachment of the front portion of the shield to the back hand portion of the glove, thereby preventing a user's fingers when the glove is worn from pivoting rearward beyond a condition of alignment with a rear of the user's hand, the projections of the shield at the front portion partially covering the corresponding projections of the protecting device.

2. The glove structure of claim 1, wherein a first of the two elements of each glove finger is shaped in the form of a U and is configured to cover a lower portion of one of the user's fingers, and a second of the two elements of each glove finger is flat and configured to cover an upper portion of one of the user's fingers.

3. The glove structure of claim 2, wherein the protecting device is formed by two layers of material, the first layer located on top of the second element of each glove finger while the second layer is located over the first layer.

4. The glove structure of claim 3, wherein the first layer is made of non-rigid polyurethane.

5. The glove structure of claim 4, wherein the first layer is direct injected on top of the second element.

6. The glove structure of claim 4, wherein the first layer is glued on top of the second element.

7. The glove structure of claim 3, wherein the second layer is made of rigid polyurethane, said second layer direct injected over the first layer.

8. The glove structure of claim 3, wherein the second layer is formed with protuberances for providing specific protection for minor knuckles of the user's hand.

9. The glove structure of claim 1, wherein the joining lines between a first and a second of the two elements of each glove finger are internal to corresponding glove finger so as to be protected in event of an accident.

10. The glove structure of claim 1, wherein the projections provided at the shield front are oval-shaped in the manner of fingernails.

11. The glove structure of claim 1, wherein the sleeve portion is provided with a rib which projects at a right angle from surface of the sleeve portion, said rib adapted for engagement by a rear edge of the shield when a user's hand arches with respect to a wrist and an arm of the user.

12. The glove structure of claim 11, wherein position of said rib on the surface of the sleeve portion is adjustable so as to allow amplitude adjustment for maximum permissible arching of the user's hand relative to the user's wrist and to the user's arm.

13. The glove structure of claim 1, wherein the shield comprises a U-shaped portion adapted to mate with a part where a thumb is attached to the glove.

14. The glove structure of claim 1, wherein an inner surface of the shield has a portion lined with a strip with one of a hook or loop fastener, said portion adapted to be fixed to a further projection made of a strip with the other of the hook or loop fastener positioned at the back hand portion of the glove.

15. The glove structure of claim 14, wherein the shield is adapted to be further fixed to the glove by means of a strap-type closure which extends between two lateral edges of the shield at the wrist portion of the glove.

16. The glove structure of claim 1, wherein the shield is permanently fixed to the back hand portion of the glove.

17. The glove structure of claim 1, wherein the two elements are formed of leather.

18. The glove structure of claim 1, wherein the joining lines between a first and a second of the two elements of each glove finger are partly covered by the protecting device.

19. The glove structure of claim 18, wherein the joining lines between the first element and the second element of each glove finger are entirely covered by the protecting device.

* * * * *